United States Patent [19]

DeLuca

[11] 4,141,619

[45] Feb. 27, 1979

[54] CONNECTOR APPARATUS FOR JOINING AN ELECTRICAL BUS WITH A TRANSFORMER STUD

[75] Inventor: Carlo B. DeLuca, Fairview, Pa.

[73] Assignee: Teledyne Penn-Union, Edinboro, Pa.

[21] Appl. No.: 862,732

[22] Filed: Dec. 21, 1977

[51] Int. Cl.[2] ..... H01R 9/10

[52] U.S. Cl. ..... 339/267; 339/268 S; 403/290

[58] Field of Search ..... 339/267, 270 R, 268; 403/289, 290, 371, 374

[56] References Cited

U.S. PATENT DOCUMENTS

| | | | |
|---|---|---|---|
| 1,978,935 | 10/1934 | Douglas | 339/267 |
| 2,279,508 | 4/1942 | Bergan | 339/267 |

FOREIGN PATENT DOCUMENTS

| | | | |
|---|---|---|---|
| 426259 | 3/1935 | United Kingdom | 339/267 |

*Primary Examiner*—Joseph H. McGlynn

*Attorney, Agent, or Firm*—Olson, Trexler, Wolters, Bushnell & Fosse, Ltd.

[57] ABSTRACT

An electrical bus includes a receptacle for mating with an external electrical connector. This receptacle defines an entrance and a tapering inner wall portion diverging inwardly of the entrance. A connecting adapter member comprises a first portion whose external periphery presents flat surfaces for engagement by a tool, and a second portion comprising a plurality of elongate tapered segments. The elongate tapered segments define a central bore and a peripheral surface generally congruent with the inner wall surface of the receptacle. The segments are resiliently inwardly compressible to effect mating with the receptacle, so as to hold the adapter member rotatably in captive relation therein. The central opening is threaded to receive a complimentarily threaded stud as for example, a transformer connector stud. Upon inserting the adapter member in captive relation in the bus receptacle, a tool is applied to the tool receiving portion thereof and the adapter rotated to threadingly engage the stud member. When the stud member bottoms or otherwise engages an abutment surface in the receptacle, the adapter member is rotated further so that the adapter advances along the stud, the outer periphery of the segments advancing to engage the inner receptacle wall. The resilient segments are thus pressed inwardly whereby the inner thread firmly engages the stud thread while the outer periphery is in firm contact with the inner receptacle wall, thus forming optimum electrical and mechanical contact between receptacle, adapter and stud.

8 Claims, 5 Drawing Figures

CONNECTOR APPARATUS FOR JOINING AN ELECTRICAL BUS WITH A TRANSFORMER STUD

BACKGROUND OF THE INVENTION

This invention is directed generally to apparatus for providing electrical connections, and more particularly to an apparatus for establishing an electrical connection between an electrical bus and a transformer stud.

While this invention may find application in a variety of electro-mechanical connective requirements, the disclosure will be facilitated by specific reference to the problem of establishing optimum electrical and mechanical connection between an underground bus bar connector and a pad mount transformer.

A number of devices have been utilized in the prior art to effect connection of a bus bar to a transformer. Generally a bushing is mounted to the transformer wall which includes a threaded stud that passes through the bushing into the transformer. The stud is used to make connection to wires or conductors within the transformer, and extends outwardly of the transformer to present a threaded surface for connection to external devices. This arrangement then provides an electrical circuit from within the transformer to external cables or the like for electrical distribution. As the use of a bushing and stud of the type described is relatively standarized, it is desirable to provide a method and apparatus for optimizing the electrical and mechanical connection between such a stud and an external device such as a distribution bus.

One approach of the prior art has been to simply provide a threaded hole within the bus and screw the bus onto the transformer stud. Often, a jam nut has been provided on the stud to mechanically lock the bus thereto. It will be recognized that this arrangement does not permit cables to be installed to the distribution bus prior to the installation of the bus to the transformer, as the bus must be rotated to join with the transformer stud. Similarly, if it is desired to remove the bus for any reason, the installed cables thereon must first be removed to permit rotation thereof for removal from the stud.

Another prior art apparatus utilizes an adapter member having a left-handed external thread in combination with a jam nut on the stud. This arrangement requires that the jam nut first be threaded downwardly on the stud, and then the adapter member, which includes a threaded opening, be threaded to a predetermined position on the stud with respect to the jam nut. The distribution bus is provided with an internally threaded receptacle for receiving the exterior thread of the adapter member, such that the adapter member may then be rotated to threadably engage the bus receptacle, and the jam nut threaded back along the transformer stud to mechanically secure the connection. It is apparent that the foregoing presents a relatively cumbersome installation procedure which invites error, especially by a relatively unskilled worker, such that an inadequate electrical and mechanical connection may result. Moreover, it will be noted that in both prior art devices matings between threaded surfaces are relied upon for electrical contact, which is generally less than desirable. Specifically, it is difficult to guarantee sufficient areas of the threaded surface will be maintained in such firm contact as to provide adequate electrical contact surfaces. Moreover, the necessity of providing an internally and externally threaded element as well as a jam nut renders that arrangement relatively expensive.

OBJECTS AND SUMMARY OF THE INVENTION

Accordingly, it is a general object of this invention to provide a new and improved apparatus for mechanically and electrically connecting an electrical bus to a threaded stud, such as a transformer stud.

A more specific object of this invention is to provide apparatus of the type described adapted to simultaneously achieve an optimum electrical and mechanical connection between a bus bar and a transformer.

Another object of this invention is to provide an apparatus of the type described which is relatively simple to assemble with a standard transformer stud so as to minimize the possibility of incorrect assembly even by a relatively unskilled worker.

Another object of this invention is to provide apparatus of the type described comprising relatively few and simple parts so as to be relatively inexpensive in its manufacture.

Briefly, connecting apparatus for establishing electrical and mechanical connection between a bus member and a threaded stud comprises a receptacle portion in the bus member including an open end and an inner abutment surface spaced apart from the open end. The receptacle also includes an interior side-wall surface diverging inwardly from said open end toward said abutment surface. An adapter member includes a base portion having tool engageable surface means and a second portion comprising a plurality of elongate resilient segments extending outwardly of said base portion. The resilient segments have peripheral side surfaces diverging outwardly of the base portion and generally congruent with the interior side-wall surfaces of the receptacle. The plurality of segments are resiliently inwardly compressible for inserting the adapter member into the receptacle to be held rotatably in captive relation therein. The adapter member further includes a threaded opening therethrough for engaging the threaded stud.

Other objects, features and advantages of this invention will be more readily appreciated upon consideration of the following detailed description together with the accompanying drawings, wherein like reference numerals are used throughout to designate like elements and components.

DETAILED DESCRIPTION OF THE ILLUSTRATED EMBODIMENT

Figure 1:
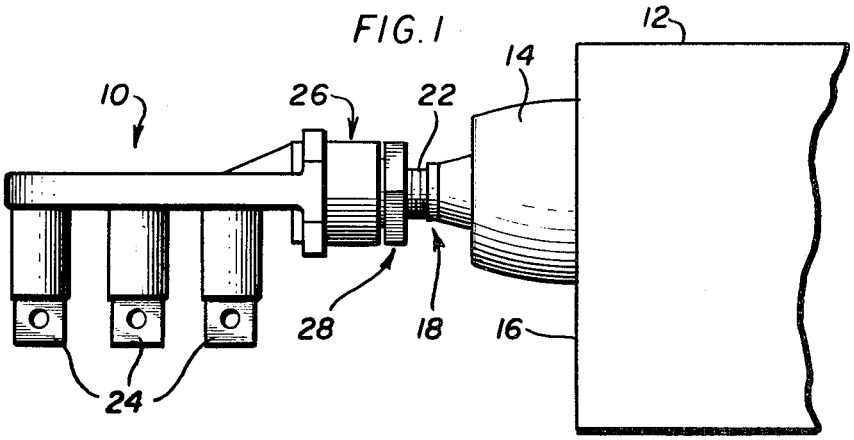
FIG. 1 is a side elevational view of an electrical bus connected with installation which may, for example, be a transformer, in which the apparatus of this invention is embodied.

Referring now to the drawings in detail, and initially to FIG. 1, an electrical installation includes an electrical bus connector or distributor 10 joined mechanically and electrically with a unit 12 which may be, for example, a transformer. In accordance with conventional practice, a bushing 14 preferably of insulating material, is mounted to a wall 16 of the transformer 12. The bushing 14 includes a stud 18 that passes therethrough and into the transformer 12. The stud 18 comprises and electrically conductive material and a part thereof (not shown) extends interiorly of the transformer 12 to provide an electrical circuit connection for wires within the transformer 12. The portion of the stud 18 extending outwardly of the transformer, through the bushing 14, includes an externally threaded portion 22 of suitable size to accommodate the electrical power to be transmitted, as for example in accordance with the electrical power rating of the transformer 12.

The bus 10 generally comprises a conductive member having a layer of insulating material applied to its exterior surface. In order to distribute electrical power to a plurality of lines, the bus 10 conventionally includes a plurality of legs or taps designated generally 24. These taps 24 have terminal end parts free of the above described insulating coating, to provide a suitable conductive surface to accommodate the connection of wire conductors thereto. While the bus 10 illustrated includes three such legs or taps 24, it will be understood that this number is exemplary only, any number of taps from one to six or more may be provided as required in a particular application. In accordance with a feature of this invention, the bus 10 includes a receptacle or socket portion 26, which will be described in detail hereinbelow. A connective or adapter member 28, also in accordance with features of this invention as will also be described below, is interposed between the socket or receptacle 26 and the threaded portion 22 of the stud 18 so as to optimize electrical and mechanical connection between the bus 10 and the transformer 12.

Figure 2:
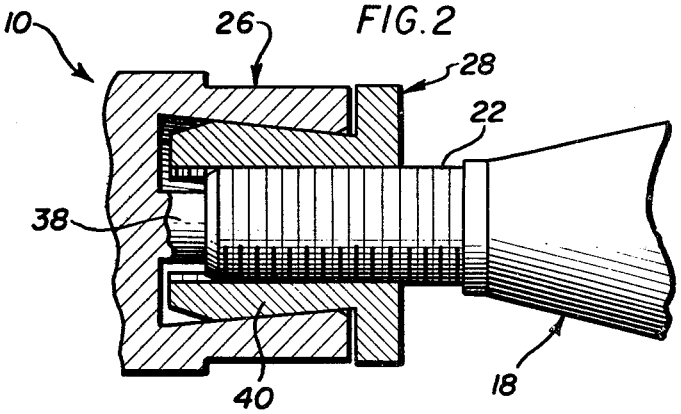
FIG. 2 is an enlarged view of a portion of FIG. 1, partially cut-away, illustrating additional details thereof in accordance with features of the present invention.
Figure 3:
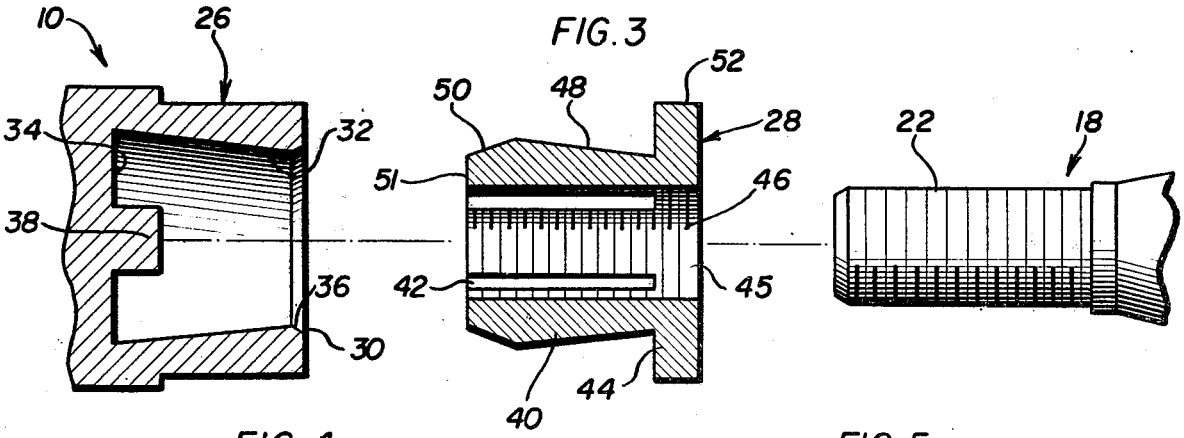
FIG. 3 is an exploded view of the elements of FIG. 2, revealing additional details thereof.
Figure 4:
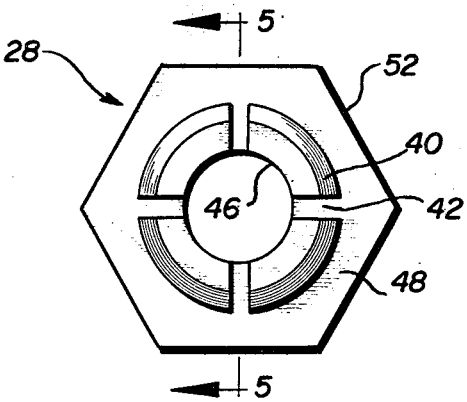
FIG. 4 is a front elevational view of a connector-adapter apparatus incorporating features of this invention.

Reference is now invited specifically to FIGS. 2 and 3, wherein advantageous features of the receptacle 26 and adapter member 28 are illustrated in additional detail. The receptacle 26 comprises a generally tubular member which has an open end 30 for receiving the connector-adapter member 28 and has an internal wall 32 that is tapered. Specifically, the internal wall 32 diverges inwardly to define generally a frustrum of a right cone, having its narrower base portion adjacent the open end 30 and its wider base forming an interior or end wall portion 34 of the receptacle 26. The bus 10 and its receptacle 26, as well as the stud 22 and the connector-adapter member 28 may be formed of any suitable conductive material capable of efficiently transmitting electrical current.

In the illustrated embodiment, a relatively short interior wall portion 36 adjacent the opening 30 flares outwardly of the interior wall 32 to define a short entrance portion of the receptacle 26. Also in the illustrated embodiment, an abutment surface 38 is provided in the base or bottom wall 34 of the receptacle 26, and generally comprises a protruding stop member of substantially smaller diameter than that of the base or end wall 34.

The connector-adapter member 28 includes four elongate resilient segments 40 separated by slots 42 and having a common base portion 44. Each of the segments 40 presents, in its inner surface, a segment of a thread continuous from a threaded aperture 45 through the base 44. These four thread segments and threaded aperture 45 cooperate to define an internal thread 46 complimentary to the external thread 22 of the stud 18. In the illustrated embodiment, the segments 40 are four in number with each extending throughout an arc of somewhat less than 90°. The outer surface of each segment is provided over its greater portion with an incline or taper 48 converging toward the base portion 44, to define a frustro-conical surface generally congruent with the interior wall portion 32 of the receptacle 26. Each segment 40 also includes an incline or tapered leading wall portion 50 extending from the wider base of the tapered wall portion 48 and converging to the front or leading edge 51 of the member 28. The taper 50 is generally congruent with the flare of the wall or entrance portion 36 of the receptacle 26.

Figure 5:
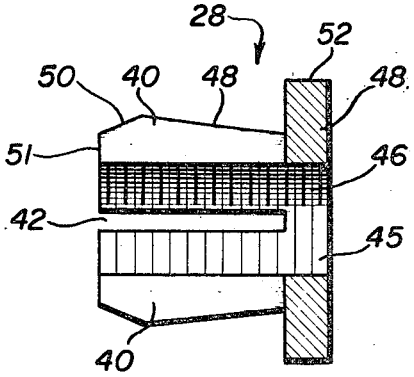
FIG. 5 is a view taken generally along the line 5—5 of FIG. 4.

The base member 44 is of substantially greater cross section than that of the segments 40 and presents an exterior periphery 52, as best seen in FIG. 5 which defines a plurality of flat surfaces suitable for gripping by a tool such as a wrench or the like. In the illustrated embodiment, the surfaces 52 define substantially a hexagon.

As illustrated in FIGS. 2 and 3, in operation, the connector-adapter member 28 is inserted in captive relation within the receptacle 26. Specifically, it will be seen that the leading edge 51 of the member 28 is of substantially smaller diameter than the opening 30 to facilitate insertion therein, the diverging tapered wall segments 50 slidably engaging the receptacle entrance walls 36 during insertion of the member 28. It will be appreciated that the segments 40 are resiliently inwardly compressible in response to the engagement of the cooperating tapered wall segments 36 and 50, to facilitate insertion into the receptacle 26. When the member 28 is inserted into the receptacle 26 to a point at which the opening 30 is substantially adjacent the base member 44, the resilient segments 40 return substantially to their original configuration. Consequently, the tapered outer wall portions 48 assume a position substantially congruent with and adjacent to the internal wall 32 of the receptacle 26. The member 28 is thus held rotatably in captive relation within the receptacle 26.

Having thus inserted the connector-adapter member 28 in the receptacle 26, the bus 10 is moved toward the stud 18, so that the thread 46 of the member 28 may engage the leading end of the thread 22 of the stud 18. The member 28 may then be rotated by grippingly engaging the surfaces 52 thereof and rotating the member 28 to effect advancement of the threads 46 with respect to the threads 22 of the stud 18. It will be noted that such rotation of the member 28 tends initially to draw the segments 40 toward the opening 30 of the receptacle 26 while rotating with respect to the inner wall surface 32, without advancing the bus 10 with respect to the stud 18. The threaded portion 22 of the stud 18 is then gradually advanced into the receptacle 26 until it engages or abuts the abutment surface 38 therein. It will be noted that the protruding portion defining the abutment surface 38 is of substantially smaller diameter than the internal thread 46 of the member 28, so as not to interfere with the rotation of the member 28. It will be further noted that the provision of a protruding abutment member 38 in the illustrated embodiment assures that some axial length of the threaded portion 22 of the stud 18 is still presented for advancement with respect to the member 28 after the abutment of the leading edge thereof at the surface 38. Without departing from the principles of the invention, however, the abutment surface 38 may be flush with the bottom wall 34 of the receptacle 26 or protrude to any desired height, as required to cooperate with the axial extent of the threaded portion 22 of the stud 18 present in a particular installation.

Following the above described abutment of the leading end of the stud 18 with the abutment surface 38, a suitable tool such as a wrench or the like is engaged with the surfaces 52 to further rotate the member 28 for advancement with respect to the stud 18. It will be appreciated that such continued axial advancement of the member 28 toward the open end 30 of the receptacle 26 will result in a corresponding increase in the relative forces of engagement between the wall 48 of the member 28 and the internal wall 32 of the receptacle 26. Such forces will tend to inwardly compress segments 40 to correspondingly increase the force applied between the threads 46 of the member 28 and the thread 22 of the stud 18. The presence of the stud 18, of course, precludes removal of the member 28 from the receptacle 26. Thus a relatively small amount of additional rotation of the member 28 in this fashion will result in a surprisingly high force of engagement being exerted between the tapered wall surfaces 32 and 48 as well as between the threaded surfaces 46 and 22. Such engagement then, in addition to providing a reliable mechanical connection between the stud 18 and bus 10, also maximizes the surface areas in electrically conductive contact for carrying electrical current between the transformer 12 and bus 10. It will also be noted that the bus 10 may be held in any desired radial position with respect to the stud 18 during the connecting process so as not to disturb wires or calbes which may already be connected to the legs 24. Similarly, it will be apparent that the member 28 may be rotated in the opposite direction to easily effect a disconnection of the bus 10 from the stud 18. Such disconnection may also readily be accomplished without disturbing any wires or cables attached to the legs 24. The member 28 is the only element which is rotated in order to effect connection or disconnection of the bus 10 and stud 18, all other parts remaining in any disired radial orientation.

What has been shown and described herein is a connecting apparatus for providing optimum electrical connection and secure mechanical mounting of a bus to a transformer. While a particular embodiment of the invention has been illustrated for exemplary purposes, the invention is not limited thereto. On the contrary, various changes and modifications may occur to those skilled in the art, and are to be understood as forming a part of this invention insofar as they fall within the spirit and scope of the appended claims.

The Invention is claimed as follows:

1. Connecting apparatus for establishing electrical and mechanical connections between a bus bar and a threaded transformer stud comprising: a receptacle portion on said bus bar having an open outer end, an interior wall portion defining substantially a section of a right cone and diverging inwardly from said open outer end and a raised cylindrical member defining an abutment surface at an inner end of the receptacle portion and generally concentric with said open outer end, and a connective adapter member comprising a base portion having a plurality of flat surfaces about an outer periphery to facilitate cooperative inter-engagement of said member with a tool, and a second portion comprising a plurality of elongate resilient segments flaring outwardly of said base portion and having outer surfaces defining a section of a right cone generally congruent with said interior wall portion, said plurality of segments being resiliently inwardly compressible for inserting said member into said receptacle to be held rotatably in captive relation therein, said connective adapter member further including an internally threaded opening therethrough in alignment with said abutment surface for receiving said stud during assembly of the bus bar with the transformer stud, said adapter member being rotatable during such assembly for relative axial movement along the stud until the stud engages said abutment surface and forces the flaring surfaces of said segments against said tapering wall surfaces.

2. Apparatus according to claim 1 wherein said elongate tapered segments are four in number and of substantially equal dimensions and define a like number of radially equally spaced slots therebetween.

3. Apparatus according to claim 1 wherein said plurality of peripheral surfaces of said base portion are six in number and define substantially a hexagonal surface for gripping with a wrench or the like.

4. A connective adapter for connecting a threaded stud member with a receptacle having an open end, an inner abutment surface and an interior wall surface diverging inwardly of said open end towards said abutment surface, said connective adapter comprising: a base portion extending outwardly of said receptacle and having surface means for accommodating a gripping tool to facilitate rotation of said connective adapter, and a second portion confluent with said first portion and comprising a plurality of elongate segments extending inwardly of said receptacle and having peripheral diverging surfaces generally congruent with the interior wall surface of said receptacle member, said segments being resiliently compressible to facilitate insertion of said second portion of said adapter member into said receptacle to be held rotatably in captive relation therein, said connective member further including a through central opening having an internal thread for engaging said threaded stud member, whereby said threaded stud member may be connected with said receptacle by the rotation of said connective adapter member alone, said threaded stud member and said receptacle remaining stationary.

5. Connecting apparatus for establishing electrical and mechanical connection between a bus member and a threaded stud comprising: a receptacle portion in said bus member including an open end and an inner abutment surface spaced apart from said open end, and an interior side-wall surface diverging inwardly from said open end toward said abutment surface; an adapter member including a base portion having tool engaeable surface means and a second portion comprising a plurality of elongate resilient segments extending outwardly of said base portion and having peripheral side surfaces diverging outwardly of said base portion and generally congruent with said interior side-wall surfaces of said receptacle, said plurality of segments being resiliently inwardly compressible for inserting said adapter member into said receptacle to be held rotatably and in captive relation therein, said adapter member further including a threaded opening therethrough for engaging said threaded stud.

6. Apparatus according to claim 5 wherein said elongate tapered segments are four in number and of substantially equal dimensions and equally radially spaced to define a like number of radially equally spaced slots of like dimensions therebetween.

7. Apparatus according to claim 6 wherein said tool engageable surface means comprises a plurality of flats which define substantially a hexagonal surface for gripping with a wrench or the like.

8. A method of connecting a transformer stud having an external thread to a bus bar including a receptacle having an interior wall surface defining a section of a right cone, comprising: providing a connective adapter member having a first portion defining peripheral surfaces for grasping by a tool, a second portion comprising a plurality of elongate reslilent segments defining a right conical peripheral surface congruent with a portion of the peripheral surface of said receptacle member adjacent the opening thereof, and a threaded aperture through said first and second portions; compressing said second portion inwardly; inserting said second portion into said receptacle to be rotatably held in captive relation therein; holding said receptacle with said captive connective adapter member adjacent a leading end of said threaded stud; gripping said first portion of said connective member with a tool; rotating said connective adapter member; threadingly advancing said connective adapter member onto said stud; bottoming said stud in said receptacle; further turning said connective member to threadably advance further upon said stud, and thereby drawing said connective adapter member toward said opening of said receptacle, causing firm contact between the outer periphery of said second portion and the interior wall surface of said receptacle and pressing said threaded aperture of said connective member firmly against said external thread of said stud.

* * * * *